US010868409B2

(12) United States Patent
Yagi et al.

(10) Patent No.: US 10,868,409 B2
(45) Date of Patent: Dec. 15, 2020

(54) SPARK PLUG

(71) Applicant: NGK SPARK PLUG CO., LTD., Nagoya (JP)

(72) Inventors: Ryouki Yagi, Komaki (JP); Masahiro Inoue, Gifu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 16 days.

(21) Appl. No.: 16/310,884

(22) PCT Filed: May 15, 2017

(86) PCT No.: PCT/JP2017/018143
§ 371 (c)(1),
(2) Date: Dec. 18, 2018

(87) PCT Pub. No.: WO2018/003320
PCT Pub. Date: Jan. 4, 2018

(65) Prior Publication Data

US 2019/0334322 A1 Oct. 31, 2019

(30) Foreign Application Priority Data

Jun. 27, 2016 (JP) ..... 2016-126792

(51) Int. Cl.
*H01T 13/20* (2006.01)
*H01T 13/02* (2006.01)

(52) U.S. Cl.
CPC ..... *H01T 13/20* (2013.01); *H01T 13/02* (2013.01)

(58) Field of Classification Search
CPC ..... H01T 13/32; H01T 13/39
See application file for complete search history.

(56) References Cited

U.S. PATENT DOCUMENTS

2003/0038577 A1 2/2003 Hori et al.
2006/0066195 A1 3/2006 Suzuki et al.
2014/0139098 A1 5/2014 Katsuraya et al.
(Continued)

FOREIGN PATENT DOCUMENTS

JP 2003-068421 A 3/2003
JP 4614207 B2 1/2011
(Continued)

OTHER PUBLICATIONS

International Search Report from corresponding International Patent Application No. PCT/JP17/18143, dated Jul. 4, 2017.

*Primary Examiner* — Joseph L Williams
*Assistant Examiner* — Jacob R Stern
(74) *Attorney, Agent, or Firm* — Kusner & Jaffe

(57) ABSTRACT

Disclosed is a spark plug in which a first electrode has a tip joined to an electrode base through a fusion zone. In a cross section of the first electrode taken along a center axis, an interface of the fusion zone and a tip includes a first region, a second region and a base point present on at least one side of the cross section. The base point is a point connection of the first and second regions and is located farthest away from the imaginary straight line in the direction parallel to the center axis. The base point is positioned so as to satisfy a condition of $0.1 \leq X/W \leq 0.4$ where W is a length of the interface in a direction perpendicular to the center axis; and X is a distance between the base point and the center axis.

2 Claims, 9 Drawing Sheets

(56) References Cited

U.S. PATENT DOCUMENTS

| | | | | |
|---|---|---|---|---|
| 2014/0203701 | A1* | 7/2014 | Kretschmar | H01T 21/02<br>313/141 |
| 2017/0033540 | A1 | 2/2017 | Suzuki | |

FOREIGN PATENT DOCUMENTS

| | | | |
|---|---|---|---|
| JP | 5337311 | B2 | 11/2013 |
| JP | 2015-125879 | A | 7/2015 |

* cited by examiner

SPARK PLUG

RELATED APPLICATIONS

This application is a National Stage of International Application No. PCT/JP17/18143 filed May 15, 2017, which claims the benefit of Japanese Patent Application No. 2016-126792, filed Jun. 27, 2016, the entire contents of which are incorporated herein by reference.

FIELD OF THE INVENTION

The present invention relates to a spark plug, particularly of the type capable of preventing separation of a tip.

BACKGROUND OF THE INVENTION

A spark plug is known, which includes: a first electrode having an electrode base and a noble metal-containing tip joined together through a fusion zone; and a second electrode facing the tip via a spark gap (see, for example, Japanese Laid-Open Patent Publication No. 2003-68421). The spark plug generates a spark discharge in the spark gap so as to form a flame kernel by ignition of an air-fuel mixture to which the first and second electrodes are exposed. At this time, there arises a thermal stress at an interface between the tip and the fusion zone because of different thermal expansion coefficients of the tip and the fusion zone.

In the above conventional technique, it is likely that a crack and an oxide scale will be developed at the interface between the tip and the fusion zone under the thermal stress. When the crack or oxide scale is excessively developed, the tip may be separated and fall off from the fusion zone.

The present invention addresses the above problem. An advantage of the present invention is a spark plug capable of preventing separation of a tip.

SUMMARY OF THE INVENTION

In accordance with a first aspect of the present invention, there is provided a spark plug comprising: a first electrode that has a column-shaped tip containing a noble metal, an electrode base supporting thereon the tip and a fusion zone at which the tip and the electrode base are fused together; and a second electrode that faces the tip via a spark gap. In a cross section of the first electrode taken along a center axis of the tip, an interface of the fusion zone and the tip includes a first region shaped to be gradually farther away from an imaginary straight line in a direction parallel to the center axis with increase in distance from the center axis, assuming that the imaginary straight line extends perpendicular to the center axis at a position closer to the second electrode than the interface; a second region shaped to be gradually closer to the imaginary straight line in the direction parallel to the center axis with increase in distance from the center axis; and a base point at which the first and second regions are connected to each other. The base point is located, among the first and second regions, farthest away from the imaginary straight line in the direction parallel to the center axis.

The first region, the second region and the base point are present on at least one side of the cross section with respect to the center axis. Further, the base point is positioned so as to satisfy a condition of $0.1 \leq X/W \leq 0.4$ where W is a length of the interface in a direction perpendicular to the center axis; and X is a distance between the base point and the center axis.

As mentioned above, the first region is shaped to be gradually farther away from the imaginary straight line in the direction parallel to the center axis with increase in distance from the center axis. The first region can thus restrict thermal expansion of the fusion zone in the direction perpendicular to the center axis so as to, on at least one side of the cross section, reduce the amount of thermal expansion of the second region relative to the tip in the direction perpendicular to the center axis. It is therefore possible to relieve a thermal stress and prevent separation of the tip.

In accordance with a second aspect of the present invention, there is provided a spark plug as described above, wherein the base point, the first region and the second region are present on each of both sides of the cross section with respect to the center axis.

In this case, a thermal stress can be suppressed on both sides of the interface with respect to the center axis. It is thus possible to more effectively prevent separation of the tip in addition to the effects of the invention of claim 1.

DETAILED DESCRIPTION OF THE EMBODIMENTS

Hereinafter, preferred embodiments of the present invention will be described blow with reference to the drawings.

Figure 1:
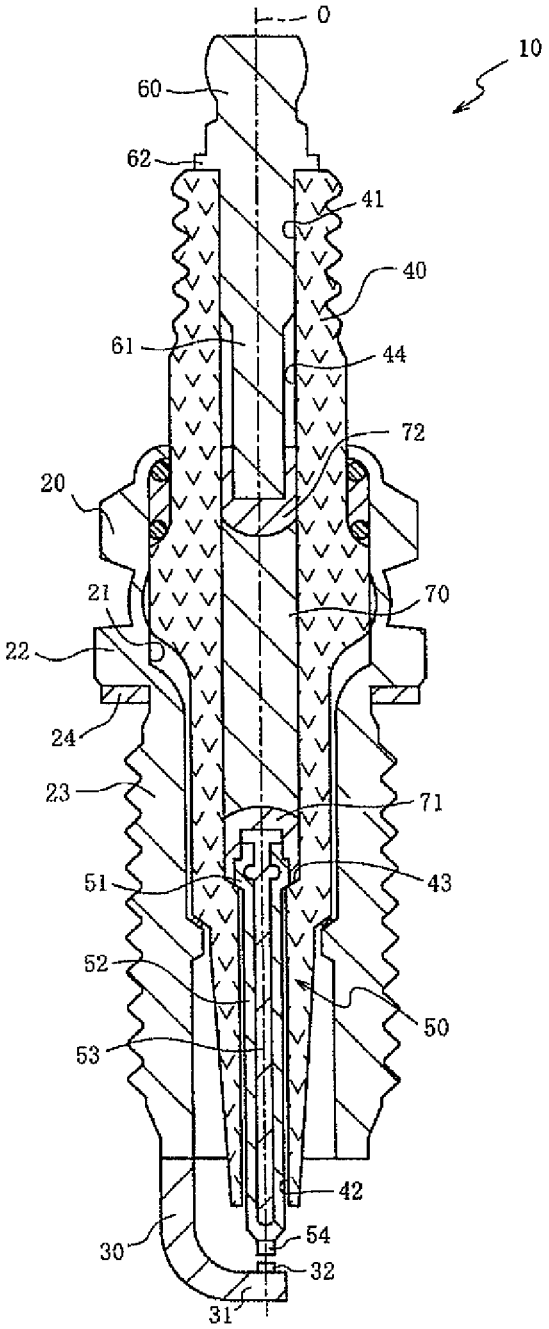
FIG. 1 is a cross-sectional view of a spark plug according to a first embodiment of the present invention.

FIG. 1 is a cross-sectional view of a spark plug 10, taken along a plane including a center axis O of the spark plug, according to the first embodiment of the present invention. In the present description, the lower and upper sides in FIG. 1 are referred to as front and rear sides of the spark plug 10, respectively. As shown in FIG. 1, the spark plug 10 is provided with a metal shell 20, a ground electrode 30, an insulator 40, a center electrode 50 and a metal terminal 60.

The metal shell 20 is substantially cylindrical-shaped so as to be fixed in a screw hole (not shown) of an internal combustion engine. A through hole 21 is formed through the metal shell 20 along the center axis O. The metal shell 20 is made of a conductive metal material (e.g. low carbon steel), and includes: a seat portion 22 radially outwardly protruding in a collar shape; and a thread portion 23 formed on an outer circumferential surface of the metal shell 20 at a position frontward of the seat portion 22.

An annular gasket 24 is fitted between the seat portion 22 and the thread portion 23. When the thread portion 23 is screwed into the screw hole of the internal combustion engine, the gasket 24 establishes a seal between the metal shell 20 and the internal combustion engine (engine head).

The ground electrode 30 has: an electrode base 31 made of a metal material (e.g. nickel-based alloy) and joined to a front end of the metal shell 20; and a tip 32 joined to a distal end portion of the electrode base 31. The electrode base 31 is rod-shaped and bent toward the center axis O so as to intersect the center axis O. The tip 32 is made in a plate shape of a noble metal e.g. platinum, iridium, ruthenium, rhodium etc. or an alloy containing such a noble metal as a main component and is joined by laser welding to the electrode base 31 at a position intersecting the center axis O.

The insulator 40 is substantially cylindrical-shaped and made of e.g. alumina having good mechanical properties and high-temperature insulating properties. An axial hole 41 is formed through the insulator 40 along the center axis O. The insulator 40 is inserted in the through hole 21 of the metal shell 20 so that the metal shell 20 is fixed on an outer circumference of the insulator 40. Front and rear ends of the insulator 40 are respectively exposed from the through hole 21 of the metal shell 20.

The axial hole 41 includes: a first hole part 42 located in a front end side of the insulator 40; a step part 43 continuing to a rear end of the first hole part 42 and having a diameter increasing toward the rear; and a second hole part 44 located rearward of the step part 43. An inner diameter of the second hole part 44 is set larger than an inner diameter of the first hole part 42.

The center electrode 50 is rod-shaped, having: a bottomed cylindrical-shaped electrode base 52; and a core 53 being higher in thermal conductivity than the electrode base 52 and embedded in the electrode base 52. The core 53 is made of e.g. copper or an alloy containing copper as a main component. A major portion of the electrode base 52 is situated in the first hole part 42. A front end of the electrode base 52 is exposed from the first hole part 42. A tip 54 is joined by laser welding to the front end of the electrode base 52.

The tip 54 is made of a noble metal e.g. platinum, iridium, ruthenium, rhodium etc. or an alloy containing such a noble metal as a main component in a cylindrical column shape. The tip 54 is opposed to and faces the tip 32 of the ground electrode 30 via a spark gap. In the first embodiment, the center electrode 50 corresponds to a first electrode; and the ground electrode 30 corresponds to a second electrode.

The metal terminal 60 is made of a conductive metal material (e.g. low carbon steel) in a rod shape for connection to a high voltage cable (not shown). A front end part of the metal terminal 60 is disposed in the axial hole 41 of the insulator 40.

A resistor 70 is disposed between the metal terminal 60 and the center electrode 50 within the second hole part 44 so as to suppress radio noise caused by spark discharge. Further, conductive glass seals 71 and 72 are respectively disposed between the resistor 70 and the center electrode 50 and between the resistor 70 and the metal terminal 60. The glass seal 71 is in contact with the resistor 70 and the center electrode 50, whereas the glass seal 72 is in contact with the resistor 70 and the metal terminal 60. As a consequence, the center electrode 50 and the metal terminal 60 are electrically connected to each other through the resistor 70 and the glass seals 71 and 72.

The above-structured spark plug 10 can be produced by, for example, the following method. First, the center electrode 50 is inserted in the second hole part 44 of the insulator 40. The tip 54 has been welded to the front end of the electrode base 52 of the center electrode 50. The center electrode 50 is then arranged such that a rear end portion 51 of the center electrode 50 is supported on the step part 43 and such that a front end portion of the center electrode 50 is exposed outside from the front end of the axial hole 41.

A raw material powder of the glass seal 71 is charged through the second hole part 44 and filled into a space around and rearward of the head portion 51. The raw material powder of the glass seal 71 filled in the second hole part 44 is pre-compressed using a compression rod member (not shown). Into a space on the thus-compressed raw material powder of the glass seal 71, a raw material powder of the resistor 70 is filled. The raw material powder of the resistor 70 filled in the second hole part 44 is pre-compressed using a compression rod member (not shown). Into a space on the thus-compressed raw material powder of the resistor 70, a raw material powder of the glass seal 72 is filled. The raw material powder of the glass seal 72 filled in the second hole part 44 is pre-compressed using a compression rod member (not shown).

After that, the front end part 61 of the metal terminal 60 is inserted into the axial hole 41 from the rear end side. The metal terminal 60 is arranged such that the front end part 61 is brought into contact with the raw material powder of the glass seal 72. The metal terminal 60 is then press-fitted until contact of a front end surface of a bulged portion 62 formed on a rear end part of the metal terminal 60 with a rear end surface of the insulator 40, so as to apply a load to the raw material powders of the glass seal 71, the resistor 70 and the glass seal 71 by the front end part 61, while heating to a temperature higher than the softening points of glass components contained in the respective raw material powders. The respective raw material powders are consequently compressed and sintered, thereby forming the glass seal 71, the resistor 70 and the glass seal 72 within the insulator 40.

Subsequently, the metal shell 20 to which the ground electrode 30 has been joined is fitted onto the outer circumference of the insulator 40. Then, the tip 32 is welded to the electrode base 31 of the ground electrode 30; and the electrode base 31 is bent such that the tip 32 of the ground electrode 30 is opposed to and faces the tip 54 of the center electrode 50 in the axis direction. In this way, the spark plug 10 is obtained.

Figure 2:
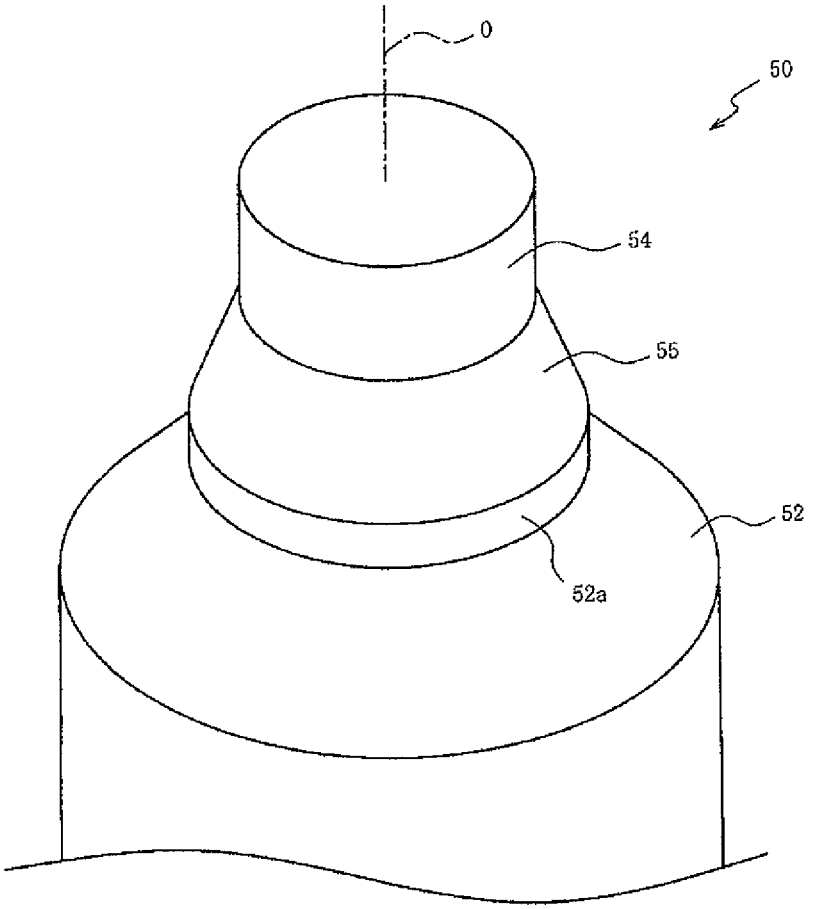
FIG. 2 is a perspective view of a first electrode of the spark plug.

FIG. 2 is a perspective view of the center electrode 50 as viewed from the tip 54 side. As shown in FIG. 2, the tip 54 is joined to the electrode base 52 of the center electrode 50 through a fusion zone 55. The tip 54 has a cylindrical column shape. The electrode base 52 has a cylindrical column-shaped front end portion 52*a* protruding toward the front. An outer diameter of the front end portion 52*a* is set slightly larger than an outer diameter of the tip 54. The fusion zone 55 is formed between the front end portion 52 and a base end surface of the tip 54 and between the front end portion 52 and the entire circumferential edge of a lateral side surface of the tip 54. Herein, the fusion zone 55 is formed by irradiation with laser light.

Figure 3:
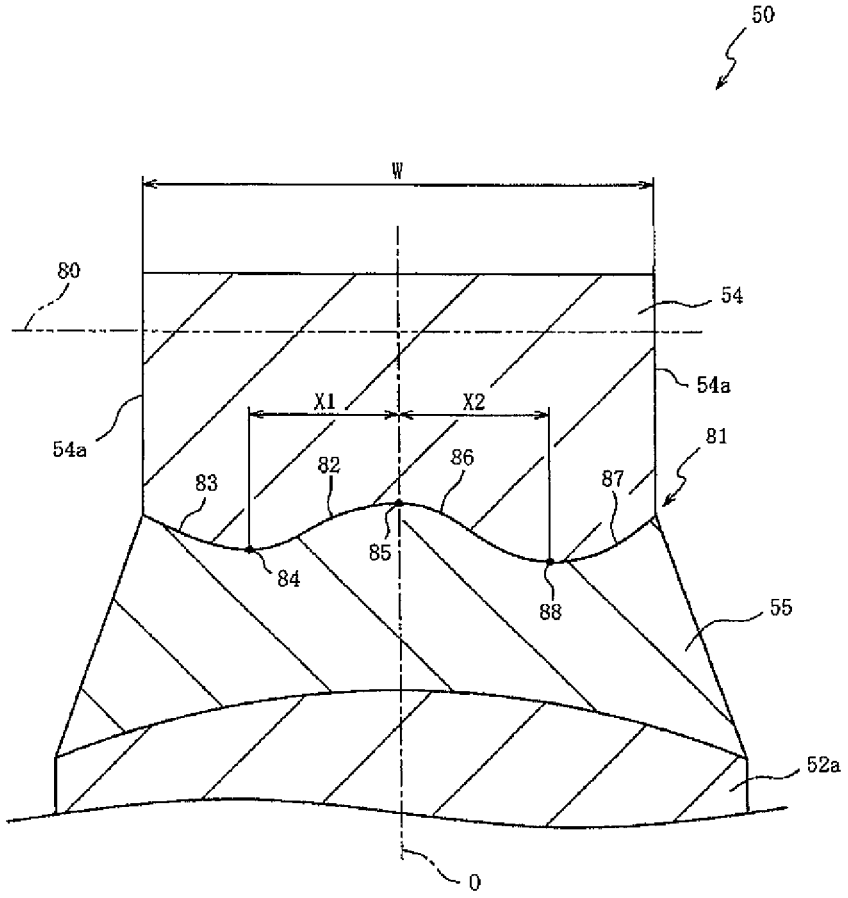
FIG. 3 is a cross-sectional view of the first electrode as taken including a center axis thereof.

FIG. 3 is a cross-sectional view of the first electrode (center electrode 50) as taken along the center axis O. In FIG. 3, an axial part of the center electrode is omitted from illustration. (In the same manner as in this figure, the axial part of center electrode 50 is also omitted from illustration in FIGS. 4 to 9.) The fusion zone 55 is a part at which the electrode base 52 and the tip 54 are fused together and is formed from one lateral side 54*a* to the other lateral side 54*a* of the tip 54. As shown in FIG. 3, an interface 81 of the fusion zone 55 and the tip 54 includes a first region 82, a second region 83 and a base point 84 on one side thereof with respect to the center axis O (i.e. on the left side in FIG. 3) and includes a first region 86, a second region 87 and a base point 88 on the other side thereof with respect to the center axis O (i.e. on the right side in FIG. 3).

At the interface 81, the second region 83, the first region 82, the first region 86 and the second region 87 are connected in this order (from the left side to the right side in FIG. 3). The first region 82 and the first region 86 are connected to each other at a vertex point 85. In the first embodiment, the vertex point 85 is situated on the center axis O. Among the first regions 82 and 86, the vertex point 85 is located closest to an imaginary straight line 80 in a direction parallel to the center axis O.

The first region 82 is a region ranging between the vertex point 85 and the base point 84 and is shaped to be gradually farther away from the imaginary straight line 80 in the direction parallel to the center axis O with increase in distance from the center axis O. The first region 82 has a point of inflection. The imaginary straight line 80 is herein defined as an imaginary line extending straight and perpendicular to the center axis O at an arbitrary position closer to the second electrode (ground electrode 30) than the interface 81 (on the upper side in FIG. 3).

The second region 83 is a region ranging between the base point 84 and the lateral side 54*a* of the tip 54 and is shaped to be gradually closer to the imaginary straight line 80 in the direction parallel to the center axis O with increase in distance from the center axis O. The second region 83 is located outward of the first region 82 in the direction perpendicular to the center axis O (hereinafter also referred to as "axis perpendicular direction"). A point of the second region 83 farthest away from the center axis O intersects the lateral side 54*a* of the tip 54.

The base point 84 is a point of connection of the first region 82 and the second region 83. Among the first and second regions 82 and 83, the base point 84 is located farthest away from the imaginary straight line 80 in the direction parallel to the center axis O.

The first region 86 is a region ranging between the vertex point 85 and the base point 88 and is shaped to be gradually farther away from the imaginary straight line 80 in the direction parallel to the center axis O with increase in distance from the center axis O. The first region 86 has a point of inflection. The second region 87 is a region ranging between the base point 88 and the lateral side 54*a* of the tip 54 and is shaped to be gradually closer to the imaginary straight line 80 in the direction parallel to the center axis O with increase in distance from the center axis O. The second region 87 is located outward of the first region 86 in the axis perpendicular direction. A point of the second region 87 farthest away from the center axis O intersects the lateral side 54*a* of the tip 54.

The base point 88 is a point of connection of the first region 86 and the second region 87. Among the first and second regions 86 and 87, the base point 88 is located farthest away from the imaginary straight line 80 in the direction parallel to the center axis O.

For example, the electrode base 52 and the tip 54 of the center electrode 50 can be joined by the following method. The tip 54 is placed on and pushed against the electrode tip 52. In a state that the tip 54 is pushed against the electrode base 52, the electrode base 52 is rotated about the center axis of the tip 54. Then, the laser light is emitted onto the vicinity of the boundary between the tip 54 and the electrode base 52 in a direction along which a beam axis of the laser light intersects the center axis of the tip 54. With this laser irradiation, the fusion zone 55 is formed between the tip 54 and the electrode base 52 from all directions.

The above laser welding is done by appropriately adjusting the output of the laser welding machine, the rotation speed of the tip 54 and the electrode base 52 and the emission position and pattern of the laser light. During the laser welding, heat is accumulated in a part of the fusion zone 55 in the vicinity of the center axis. As a result, the part of the fusion zone 55 in the vicinity of the center axis O is budged in the axis direction whereby the first regions 82 and 86, the second regions 83 and 87 and the base points 84 and 88 are defined at the interface 81 of the fusion zone 55 and the tip 54.

The fusion zone 55 is higher in thermal expansion coefficient than the tip 54. When the tip 54 and the fusion zone 55 thermally expand in the axis perpendicular direction during use of the spark plug 10, the tip 54 serves as a barrier against the fusion zone 55 through the first region 82 due to a difference in thermal expansion coefficient between the tip 54 and the fusion zone 55 so as to restrict expansion of the fusion zone 55. The second region 83 of the fusion zone 55 expands outwardly of the first region 82 in the axis perpendicular direction. However, the amount of thermal expansion of the second region 83 relative to the tip 54 in the axis perpendicular direction is decreased as the second region 83 is made shorter by an amount of the first region 82. A thermal stress on the second region 83, which intersects the lateral side 54*a* of the tip 54, can be thus relieved so as to prevent the second region 83 from being open. This makes it less likely that a crack and an oxide scale will be developed at the second region 83. It is accordingly possible to prevent separation of the tip 54 from the fusion zone 55. The first region 86 functions in the same manner as the first region 82.

The base point 84 is positioned so as to satisfy the condition of $0.1 \leq X1/W \leq 0.4$ where W is a length (linear dimension) of the interface 81 in the direction perpendicular to the center axis O (axis perpendicular direction); and X1 is a distance between the base point 84 and the center axis O. Further, the base point 88 is positioned so as to satisfy the condition of $0.1 \leq X2/W \leq 0.4$ where X2 is a distance between the base point 88 and the center axis O. It is possible with this configuration to effectively prevent separation of the tip 54 from the fusion zone 55.

When the base point 84 is positioned so as to satisfy the condition of $X1/W \leq 0.1$, the first region 82 is relatively short and poor in barrier effect. Thus, the function of the first region 82 to restrict expansion of the fusion zone 55 becomes lowered. When the base point 84 is positioned so as to satisfy the condition of $X1/W > 0.4$, on the other hand, the first region 82 is relatively long. Even though the tip 54 serves as a barrier through the first region 82, it is difficult for the tip 54 to resist expansion of the fusion zone 55. The tip 54 becomes thus likely to be separated from the fusion zone 55. These problems can however be solved when the base point 84 is positioned so as to satisfy the condition of $0.1 \leq X1/W \leq 0.4$. The same applies to the base point 88.

The first region 82, the second region 83 and the base point 84 are present as one set on one side of the cross section with respect to the center axis O (left side in FIG. 3), whereas the first region 86, the second region 87 and the base point 88 are present as one set on the other side of the cross section with respect to the center axis O (right side in FIG. 3). With this configuration, it is possible to suppress a thermal stress on each of both sides of the interface 81 with respect to the center axis O and thereby possible to more effectively prevent separation of the tip 54.

Furthermore, each of the first regions 82 and 86 has a point of inflection as mentioned above. The presence of such an inflection point leads to a decrease in the curvature radius of the first region 82, 86 in the vicinities of the base point 84, 88 and the vertex point 85 and a decrease in the inclination of the first region 82, 86 relative to the center axis O in the vicinities of the base point 84, 88 and the vertex point 85 as compared to the case where the first region has no inflection point. As a consequence, a load caused due to the difference in thermal expansion between the tip 54 and the fusion zone 55 can be prevented from being concentrated on the vicinities of the base point 84, 88 and the vertex point 85. It is thus possible to suppress a load on the vicinities of the base point 84, 88 and the vertex point 85 and prevent the occurrence of a crack in the interface 81.

Next, the second embodiment of the present invention will be explained below with reference to FIG. 4. In the first embodiment, the base point 84, 88, the first region 82, 86 and the second region 83, 87 are present as one set on each of both sides of the cross section of the first electrode with reference to the center axis O. In the second embodiment, by contrast, a first region 92, a second region 93 and a base point 94 are present on one side of the cross section of the first electrode with reference to the center axis O. It is herein noted that, in the second embodiment, like parts and portions to those of the first embodiment are designated by like reference numerals to omit detailed explanations thereof.

Figure 4:
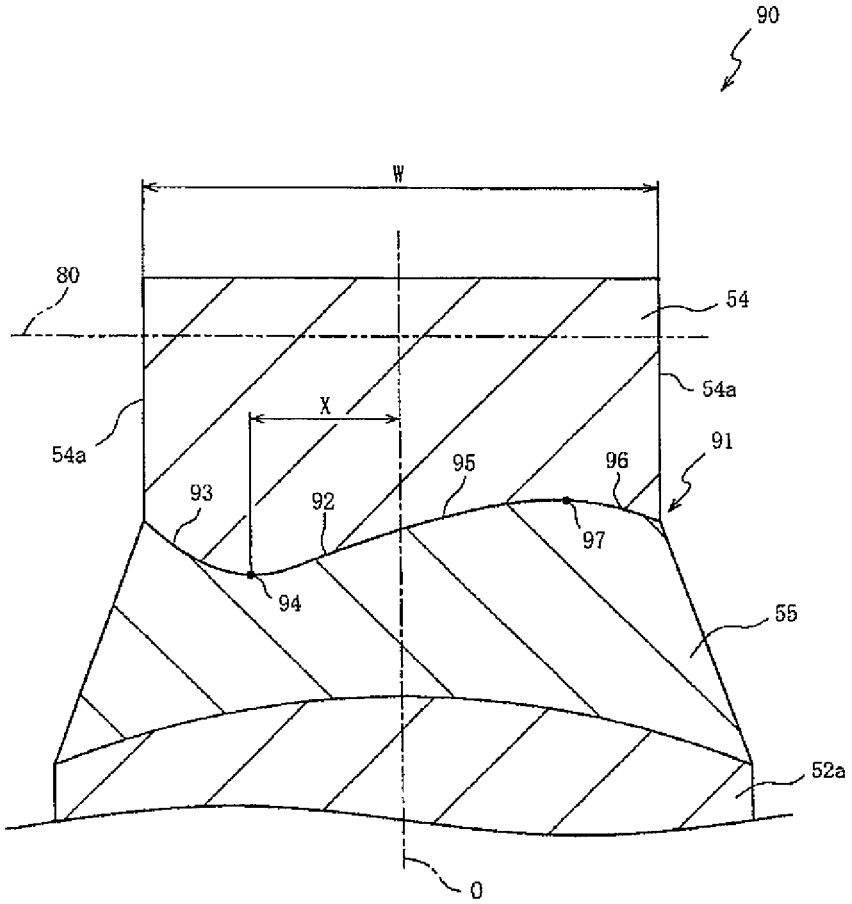
FIG. 4 is a cross-sectional view of a first electrode of a spark plug, as taken including a center axis thereof, according to a second embodiment of the present invention.

FIG. 4 is a cross-sectional view of the first electrode (center electrode 90), as taken along the center axis O, according to the second embodiment. In the spark plug 10, the center electrode 90 is provided in place of the center electrode 50 of the first embodiment. (The same applies to the third and other embodiments.) As shown in FIG. 4, an interface 91 of the fusion zone 55 and the tip 54 includes the first region 92, the second region 93 and the base point 94 on one side thereof with respect to the center axis O (i.e. on the left side in FIG. 4).

At the interface 91, the second region 93, the first region 92, a second region 95 and a first region 96 are connected in this order (from the left side to the right side in FIG. 4). The first region 92 is a region ranging between the center axis O and the base point 94 and is shaped to be gradually farther away from the imaginary straight line 80 in the direction parallel to the center axis O with increase in distance from the center axis O. The first region 92 has a point of inflection. The second region 93 is a region ranging between the base point 94 and the lateral side 54*a* of the tip 54 and is shaped to be gradually closer to the imaginary straight line 80 in the direction parallel to the center axis O with increase in distance from the center axis O. The second region 93 is located outward of the first region 92 in the axis perpendicular direction. A point of the second region 93 farthest away from the center axis O intersects the lateral side 54*a* of the tip 54.

The base point 94 is a point of connection of the first region 92 and the second region 93. Among the first and second regions 92 and 93, the base point 94 is located farthest away from the imaginary straight line 80 in the direction parallel to the center axis O. Further, the base point 94 is positioned so as to satisfy the condition of $0.1 \leq X/W \leq 0.4$ where W is a length (linear dimension) of the interface 91 in the axis perpendicular direction; and X is a distance between the base point 94 and the center axis O.

The second region 95 is a region ranging between the center axis O and a vertex point 97 and is shaped to be gradually closer to the imaginary straight line 80 in the direction parallel to the center axis O with increase in distance from the center axis O. The first region 96 is a region ranging between the vertex point 97 and the lateral side 54*a* of the tip 54 and is shaped to be gradually farther away from the imaginary straight line 80 in the direction parallel to the center axis O with increase in distance from the center axis O. Among the second and first regions 95 and 96, the vertex point 97 is located closest to the imaginary straight line 80 in the direction parallel to the center axis O.

When the tip 54 and the fusion zone 55 thermally expand in the axis perpendicular direction, the tip 54 serves as a barrier against the fusion zone 55 through the first region 92 due to a difference in thermal expansion coefficient between the tip 54 and the fusion zone 55 so as to restrict expansion of the fusion zone 55 in the second embodiment as in the case of the first embodiment. The amount of thermal expansion of the second region 93 relative to the tip 54 in the axis perpendicular direction is decreased as the second region 83 is made shorter by an amount of the first region 82. This makes it less likely that a crack and an oxide scale will be developed at the second region 93 which intersects the lateral side 54*a* of the tip 54. It is thus possible to prevent separation of the tip 54 from the fusion zone 55.

Figure 5:
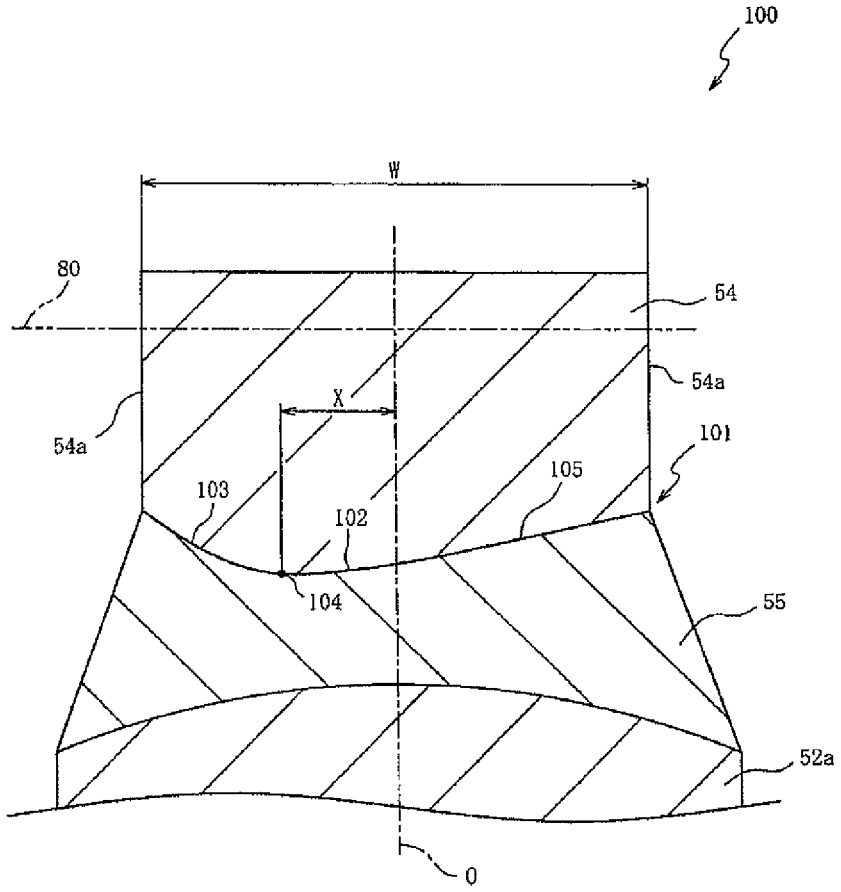
FIG. 5 is a cross-sectional view of a first electrode of a spark plug, as taken including a center axis thereof, according to a third embodiment of the present invention.

The third embodiment of the present invention will be next explained below with reference to FIG. 5. It is herein noted that, in the third embodiment, like parts and portions to those of the first embodiment are designated by like reference numerals to omit detailed explanations thereof. FIG. 5 is a cross-sectional view of the first embodiment (center electrode 100), as taken along the center axis O, according to the third embodiment. As shown in FIG. 5, an interface 101 of the fusion zone 55 and the tip 54 includes a first region 102, a second region 103 and a base point 104 on one side thereof with respect to the center axis O (i.e. on the left side in FIG. 5).

At the interface 101, the second region 103, the first region 102 and a second region 105 are connected in this order (from the left side to the right side in FIG. 5). The first region 102 is a region ranging between the center axis O and the base point 104 and is shaped to be gradually farther away from the imaginary straight line 80 in the direction parallel to the center axis O with increase in distance from the center axis O. The second region 103 is a region ranging between the base point 104 and the lateral side 54*a* of the tip 54 and is shaped to be gradually closer to the imaginary straight line 80 in the direction parallel to the center axis O with increase in distance from the center axis O. The second region 103 is located outward of the first region 102 in the axis perpendicular direction. A point of the second region 103 farthest away from the center axis O intersects the lateral side 54*a* of the tip 54.

The base point 104 is a point of connection of the first region 102 and the second region 103. Among the first and second regions 102 and 103, the base point 104 is located farthest away from the imaginary straight line 80 in the direction parallel to the center axis O. Further, the base point 104 is positioned so as to satisfy the condition of $0.1 \leq X/W \leq 0.4$ where W is a length (linear dimension) of the interface 101 in the axis perpendicular direction; and X is a distance between the base point 104 and the center axis O.

The second region 105 is a region ranging between the center axis O and the lateral side 54*a* of the tip 54 and is shaped to be gradually closer to the imaginary straight line 80 in the direction parallel to the center axis O with increase in distance from the center axis O. When the tip 54 and the fusion zone 55 thermally expand in the axis perpendicular direction, the tip 54 serves as a barrier against the fusion zone 55 through the first region 102 due to a difference in thermal expansion coefficient between the tip 54 and the fusion zone 55 so as to restrict expansion of the fusion zone 55 in the third embodiment as in the case of the first embodiment. As the amount of thermal expansion of the second region 103 in the axis perpendicular direction is decreased, it is less likely that a crack and an oxide scale will be developed at the second region 103.

Figure 6:
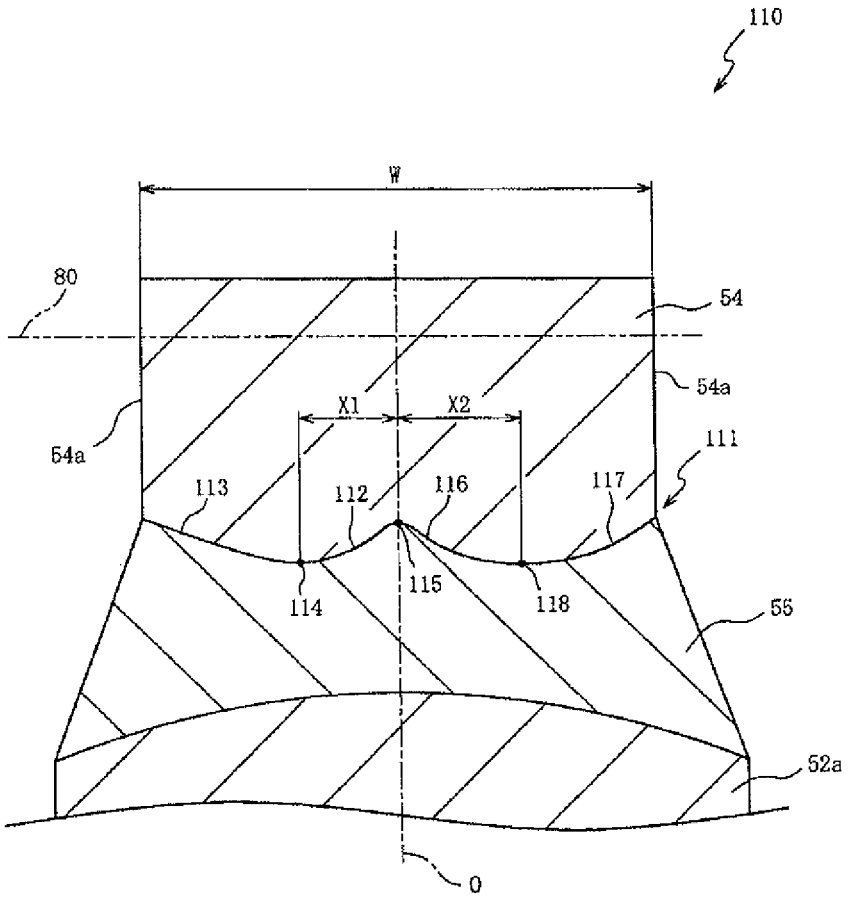
FIG. 6 is a cross-sectional view of a first electrode of a spark plug, as taken including a center axis thereof, according to a fourth embodiment of the present invention.

The fourth embodiment of the present invention will be explained below with reference to FIG. 6. It is herein noted that, in the sixth embodiment, like parts and portions to those of the first embodiment are designated by like reference numerals to omit detailed explanations thereof. FIG. 6 is a cross-sectional view of the first embodiment (center electrode 110), as taken along the center axis O, according to the fourth embodiment.

As shown in FIG. 6, an interface 111 of the fusion zone 55 and the tip 54 includes a first region 112, a second region 113 and a base point 114 on one side thereof with respect to the center axis O (i.e. on the left side in FIG. 6) and includes a first region 116, a second region 117 and a base point 118 on the other side thereof with respect to the center axis O (i.e. on the right side in FIG. 6). At the interface 111, the second region 113, the first region 112, the first region 116 and the second region 117 are connected in this order (from the left side to the right side in FIG. 6). The first region 112 and the first region 116 are connected to each other at a vertex point 115. In the fourth embodiment, the vertex point 115 is situated on the center axis O.

The first region 112 is a region ranging between the vertex point 115 and the base point 114 and is shaped to be gradually farther away from the imaginary straight line 80 in the direction parallel to the center axis O with increase in distance from the center axis O. The first region 112 has a point of inflection. The second region 113 is a region ranging between the base point 114 and the lateral side 54*a* of the tip 54 and is shaped to be gradually closer to the imaginary straight line 80 in the direction parallel to the center axis O with increase in from the center axis O. The base point 114 is located, among the first and second regions 112 and 113, farthest away from the imaginary straight line 80 in the direction parallel to the center axis O.

The first region 116 is a region ranging between the vertex point 115 and the base point 118 and is shaped to be gradually farther away from the imaginary straight line 80 in the direction parallel to the center axis O with increase in distance from the center axis O. The first region 116 has a point of inflection. The second region 117 is a region ranging between the base point 118 and the lateral side 54*a* of the tip 54 and is shaped to be gradually closer to the imaginary straight line 80 in the direction parallel to the center axis O with increase in distance from the center axis O. The base point 118 is located, among the first and second regions 116 and 117, farthest away from the imaginary straight line 80 in the direction parallel to the center axis O.

The base point 114 is positioned so as to satisfy the condition of $0.1 \leq X1/W \leq 0.4$ where W is a length (linear dimension) of the interface 111 in the axis perpendicular direction; and X1 is a distance between the base point 114 and the center axis O. Further, the base point 118 is positioned so as to satisfy the condition of $0.1 \leq X2/W \leq 0.4$ where X2 is a distance between the base point 118 and the center axis O. Since the fourth embodiment is similar in configuration to the first embodiment, it is possible in the fourth embodiment to obtain the same effects as those in the first embodiment.

Figure 7:
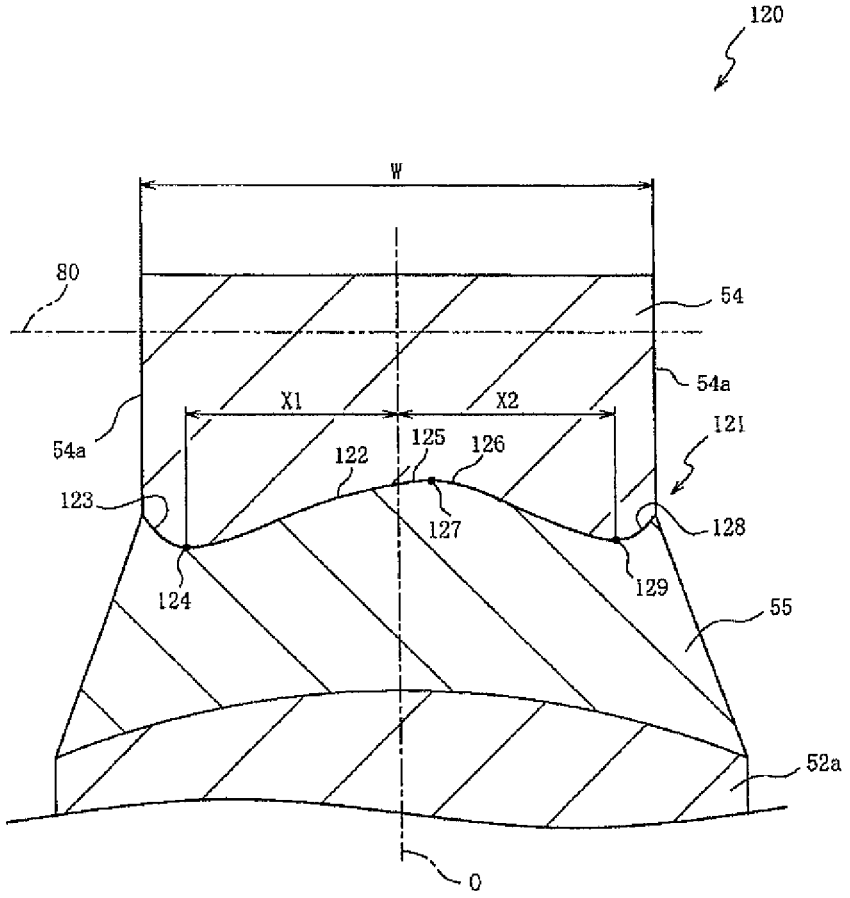
FIG. 7 is a cross-sectional view of a first electrode of a spark plug, as taken including a center axis thereof, according to a fifth embodiment of the present invention.

The fifth embodiment of the present invention will be explained below with reference to FIG. 7. It is herein noted that, in the fifth embodiment, like parts and portions to those of the first embodiment are designated by like reference numerals to omit detailed explanations thereof. FIG. 7 is a cross-sectional view of the first embodiment (center electrode 120), as taken along the center axis O, according to the fifth embodiment.

As shown in FIG. 7, an interface 121 of the fusion zone 55 and the tip 54 includes a first region 122, a second region 123 and a base point 124 on one side thereof with respect to the center axis O (i.e. on the left side in FIG. 7) and includes a first region 126, a second region 128 and a base point 129 on the other side thereof with respect to the center axis O (i.e. on the right side in FIG. 7). At the interface 121, the second region 123, the first region 122, a second region 125, the first region 126 and the second region 128 are connected in this order (from the left side to the right side in FIG. 7).

The first region 122 is a region ranging between the center axis O and the base point 124 and is shaped to be gradually farther away from the imaginary straight line 80 in the direction parallel to the center axis O with increase in distance from the center axis O. The first region 122 has a point of inflection. The second region 123 is a region ranging between the base point 124 and the lateral side 54*a* of the tip 54 and is shaped to be gradually closer to the imaginary straight line 80 in the direction parallel to the center axis O with increase in distance from the center axis O. The base point 124 is located, among the first and second regions 122 and 123, farthest away from the imaginary straight line 80 in the direction parallel to the center axis O.

The second region 125 is a region ranging between the center axis O and a vertex point 127 and is shaped to be gradually closer to the imaginary straight line 80 in the direction parallel to the center axis O with increase in distance from the center axis O. The first region 126 is a region ranging between the vertex point 127 and the base point 129 and is shaped to be gradually farther away from the imaginary straight line 80 in the direction parallel to the center axis O with increase in distance from the center axis O. The first region 126 has a point of inflection. The second region 128 is a region ranging between the base point 129 and the lateral side 54*a* of the tip 54 and is shaped to be gradually closer to the imaginary straight line 80 in the direction parallel to the center axis O with increase in distance from the center axis O. The base point 129 is located, among the first and second regions 126 and 128, farthest away from the imaginary straight line 80 in the direction parallel to the center axis O.

The base point 124 is positioned so as to satisfy the condition of $0.1 \leq X1/W \leq 0.4$ where W is a length (linear dimension) of the interface 121 in the axis perpendicular direction; and X1 is a distance between the base point 124 and the center axis O. Further, the base point 129 is positioned so as to satisfy the condition of $0.1 \leq X2/W \leq 0.4$ where X2 is a distance between the base point 129 and the center axis O. Since the fifth embodiment is also similar in configuration to the first embodiment, it is possible in the fifth embodiment to obtain the same effects as those in the first embodiment.

Figure 8:
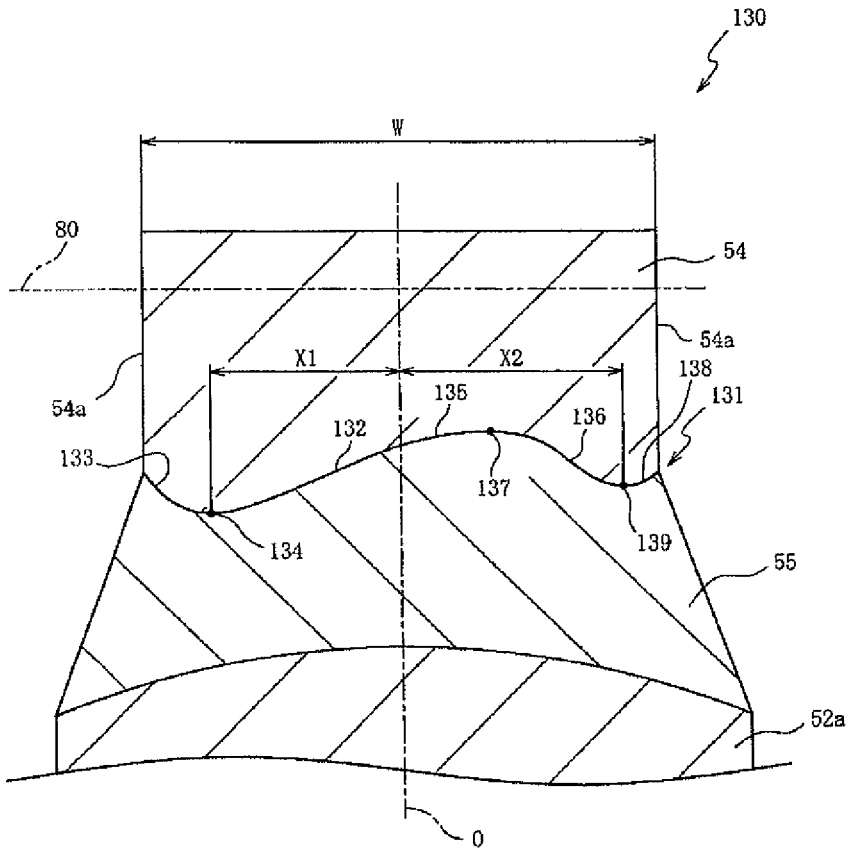
FIG. 8 is a cross-sectional view of a first electrode of a spark plug, as taken including a center axis thereof, according to a sixth embodiment of the present invention.

The sixth embodiment of the present invention will be explained below with reference to FIG. 8. It is herein noted that, in the sixth embodiment, like parts and portions to those of the first embodiment are designated by like reference numerals to omit detailed explanations thereof. FIG. 8 is a cross-sectional view of the first embodiment (center electrode 130), as taken along the center axis O, according to the sixth embodiment.

As shown in FIG. 8, an interface 131 of the fusion zone 55 and the tip 54 includes a first region 132, a second region 133 and a base point 134 on one side thereof with respect to the center axis O (i.e. on the left side in FIG. 8) and includes a first region 136, a second region 138 and a base point 139 on the other side thereof with respect to the center axis O (i.e. on the right side in FIG. 8). At the interface 131, the second region 133, the first region 132, a second region 135, the first region 136 and the second region 138 are connected in this order (from the left side to the right side in FIG. 8).

The first region 132 is a region ranging between the center axis O and the base point 134 and is shaped to be gradually farther away from the imaginary straight line 80 in the direction parallel with the center axis O with increase in distance from the center axis O. The first region 132 has a point of inflection. The second region 133 is a region ranging between the base point 134 and the lateral side 54*a* of the tip 54 and is shaped to be gradually closer to the imaginary straight line 80 in the direction parallel with the center axis O with increase in distance from the center axis O. The base point 134 is located, among the first and second regions 132 and 133, farthest away from the imaginary straight line 80 in the direction parallel to the center axis O.

The second region 135 is a region ranging between the center axis O and a vertex point 137 and is shaped to be gradually closer to the imaginary straight line 80 in the direction parallel to the center axis O with increase in distance from the center axis O. The first region 136 is a region ranging between the vertex point 137 and the base point 139 and is shaped to be gradually farther away from the imaginary straight line 80 in the direction parallel to the center axis O with increase in distance from the center axis O. The first region 136 has a point of inflection. The second region 138 is a region ranging between the base point 139 and the lateral side 54*a* of the tip 54 and is shaped to be gradually closer to the imaginary straight line 80 in the direction parallel to the center axis O with increase in distance from the center axis O. The base point 139 is located, among the first and second regions 136 and 138, farthest away from the imaginary straight line 80 in the direction parallel to the center axis O.

The base point 134 is positioned so as to satisfy the condition of $0.1 \leq X1/W \leq 0.4$ where W is a length (linear dimension) of the interface 131 in the axis perpendicular direction; and X1 is a distance between the base point 134 and the center axis O. Further, the base point 139 is positioned so as to satisfy the condition of $0.1 \leq X2/W \leq 0.4$ where X2 is a distance between the base point 139 and the center axis O. Since the sixth embodiment is also similar in configuration to the first embodiment, it is possible in the sixth embodiment to obtain the same effects as those in the first embodiment.

Figure 9:
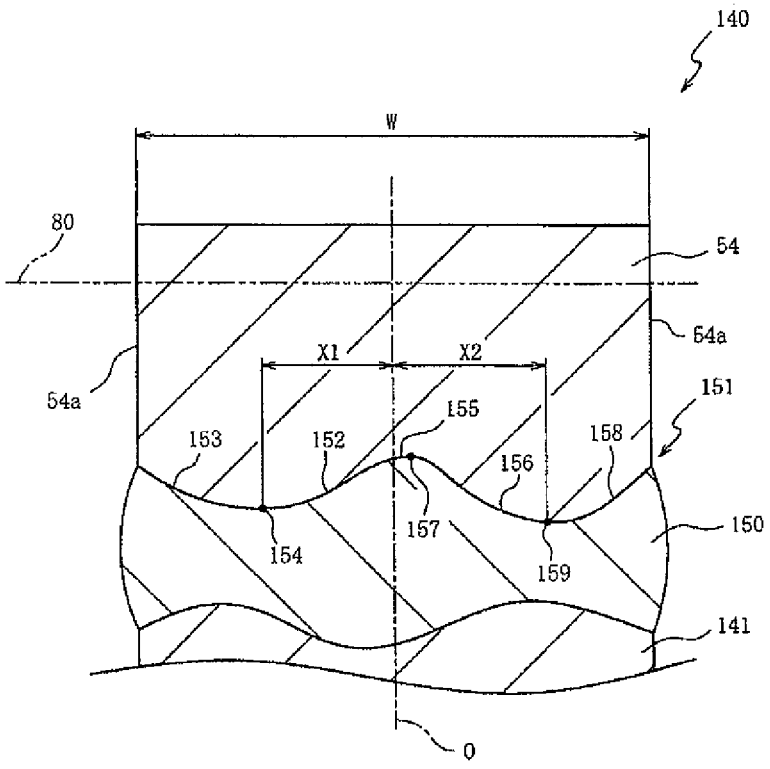
FIG. 9 is a cross-sectional view of a first electrode of a spark plug, as taken including a center axis thereof, according to a seventh embodiment of the present invention.

The seventh embodiment of the present invention will be explained below with reference to FIG. 9. It is herein noted that, in the seventh embodiment, like parts and portions to those of the first embodiment are designated by like reference numerals to omit detailed explanations thereof. FIG. 9 is a cross-sectional view of the first embodiment (center electrode 140), as taken along the center axis O, according to the seventh embodiment. In the center electrode 140, a tip 54 is joined to an electrode base 141 through a fusion zone 150.

As shown in FIG. 9, an interface 151 of the fusion zone 150 and the tip 54 includes a first region 152, a second region 153 and a base point 154 on one side thereof with respect to the center axis O (i.e. on the left side in FIG. 9) and includes a first region 156, a second region 158 and a base point 159 on the other side thereof with respect to the center axis O (i.e. on the right side in FIG. 9). At the interface 151, the second region 153, the first region 152, a second region 155, the first region 156 and the second region 158 are connected in this order (from the left side to the right side in FIG. 9).

The first region 152 is a region ranging between the center axis O and the base point 154 and is shaped to be gradually farther away from the imaginary straight line 80 in the direction parallel to the center axis O with increase in distance from the center axis O. The first region 152 has a point of inflection. The second region 153 is a region ranging between the base point 154 and the lateral side 54*a* of the tip 54 and is shaped to be gradually closer to the imaginary straight line 80 in the direction parallel to the center axis O with increase in distance from the center axis O. The base point 154 is located, among the first and second regions 152 and 153, farthest away from the imaginary straight line 80 in the direction parallel to the center axis O.

The second region 155 is a region ranging between the center axis O and a vertex point 157 and is shaped to be gradually closer to the imaginary straight line 80 in the direction parallel to the center axis O with increase in distance from the center axis O. The first region 156 is a region ranging between the vertex point 157 and the base point 159 and is shaped to be gradually farther away from the imaginary straight line 80 in the direction parallel to the center axis O with increase in distance from the center axis O. The first region 156 has a point of inflection. The second region 158 is a region ranging between the base point 159 and the lateral side 54*a* of the tip 54 and is shaped to be gradually closer to the imaginary straight line 80 in the direction parallel to the center axis O with increase in distance from the center axis O. The base point 159 is located, among the first and second regions 156 and 158, farthest away from the imaginary straight line 80 in the direction parallel to the center axis O.

The base point 154 is positioned so as to satisfy the condition of $0.1 \leq X1/W \leq 0.4$ where W is a length (linear dimension) of the interface 151 in the axis perpendicular direction; and X1 is a distance between the base point 154 and the center axis O. Further, the base point 159 is positioned so as to satisfy the condition of $0.1 \leq X2/W \leq 0.4$ where X2 is a distance between the base point 159 and the center axis O. Since the seventh embodiment is also similar in configuration to the first embodiment, it is possible in the seventh embodiment to obtain the same effects as those in the first embodiment.

EXAMPLES

The present invention will be described in more detail below by way of the following examples. It should be noted that the following explanations are illustrative and are not intended to limit the present invention thereto.

(Sample Preparation)

Tips were respectively made of an iridium alloy in a cylindrical column shape with a diameter of 0.5 mm and a height of 0.65 mm or with a diameter of 0.8 mm and a height of 0.6 mm. Electrode bases were respectively made of a nickel alloy (available under the trade name of Inconel 600). Front end portions of the electrode bases to which the tips were to be joined were formed with a diameter of 0.85 mm for the 0.55-mm diameter tips or a diameter of 1.1 mm for the 0.8-mm diameter tips.

Various center electrodes (as first electrodes) were each provided by welding the tip to the electrode base while adjusting the output of the laser welding machine and the emission position and pattern of the laser light. Cross sections of the center electrodes taken along the center axis O were observed by a nondestructive method with an X-ray fluoroscopic device. Some of the center electrodes, including those in which a base point was present at the interface of the tip and the fusion zone and those in which a base point was absent at the interface of the tip and the fusion zone, were randomly selected. Various spark plugs (sample No. 1 to No. 7) were produced using these selected center electrodes. In each spark plug, the fusion zone of the center electrode was analyzed. It was confirmed from the analysis results that the noble metal component derived from the tip was contained in an amount of 25 to 35 wt % in the fusion zone.

(Heating/Cooling Test)

Sample No. 1 to No. 7 were subjected to 1000 cycles of heating/cooling test assuming that one cycle consisted of heating the front end portion of the center electrode of the spark plug to 1000° C. with a burner for 2 minutes and cooling the spark plug for 1 minute.

(Assessment)

After the heating/cooling test, each of the samples was examined with an X-ray fluoroscopic device to look for a site of the sample in which the base point was present at the interface of the fusion zone and the tip. As this site, a cross section of the center electrode was taken along the center axis. The cross section was then treated by grinding. There was thus obtained the ground cross section in which the base point appeared. The ground cross section was observed with a metallurgical microscope. On each side of the cross section with respect to the center axis, the distance X between the base point and the center axis and the length L of an oxide scale (where separation of the tip occurred) at the interface of the fusion zone and the tip were measured. The value of X/W was calculated to the second decimal place by dividing the length W of the interface in the axis perpendicular direction (which was equal to the diameter of the tip) by the length X.

The length L of the oxide scale was measured on each side of the cross section with respect to the center axis. The rate (%) of the oxide scale relative to the radius of the tip was determined by dividing the length L by 0.5W (that is, the radius of the tip). The assessment result was indicated as: "excellent (◎)" when the oxide scale rate was lower than 50%; "good (○)" when the oxide scale rate was higher than or equal to 50% and lower than 80%; and "poor (x)" when the oxide scale rate was higher than or equal to 80%.

TABLE 1 shows the test results of Sample No. 1 to 7. In TABLE 1, the measurement side of the cross section with respect to the center axis (left or right side of the cross section with respect to the center axis) is indicated as "left" or "right" in the column of "Cross section".

TABLE 1

| | Tip W: mm | Cross section | Presence or absence of base point | X/W | Assessment result |
|---|---|---|---|---|---|
| Sample No. 1 | 0.55 | left | absent | — | X |
| | | right | absent | — | X |

TABLE 1-continued

| | Tip W: mm | Cross section | Presence or absence of base point | X/W | Assessment result |
|---|---|---|---|---|---|
| Sample No. 2 | 0.55 | left | present | 0.25 | ◎ |
| | | right | present | 0.33 | ◎ |
| Sample No. 3 | 0.55 | left | present | 0.05 | ○ |
| | | right | present | 0.40 | ◎ |
| Sample No. 4 | 0.55 | left | present | 0.10 | ◎ |
| | | right | present | 0.43 | ○ |
| Sample No. 5 | 0.80 | left | absent | — | X |
| | | right | present | 0.10 | ◎ |
| Sample No. 6 | 0.80 | left | present | 0.07 | ○ |
| | | right | present | 0.40 | ◎ |
| Sample No. 7 | 0.80 | left | present | 0.34 | ◎ |
| | | right | present | 0.43 | ○ |

As is apparent from TABLE 1, the rate of the oxide scale at the interface was lower than 80% (i.e. the assessment result was ◎ or ○) when the base point was present at the interface. At this oxide scale rate, the value of X/W rounded off to the first decimal place was in the range of $0.1 \leq X/W \leq 0.4$. In particular, the rate of the oxide scale at the interface was lower than 50% (i.e. the assessment result was ◎) in the range of $0.10 \leq X/W \leq 0.40$.

Although the present invention has been described with reference to the above specific embodiments, the present invention is not limited to these specific embodiments. It is readily understood that various changes and modifications of the embodiments described above can be made within the range that does not depart from the scope and spirit of the present invention.

For example, the above-mentioned shapes, sizes and materials of the electrode base 52 and the tip 54 are mere examples and can be set as appropriate.

Although the tip 54 is cylindrical column-shaped in the above embodiments, the tip 54 is not necessarily limited to such a shape. The tip 54 can be set to any appropriate shape such as elliptical column shape, polygonal column shape or the like.

The above embodiments specifically refer to the case where the tip 54 is welded to the electrode base 52, 141 of the center electrode (that is, the center electrode corresponds to the first electrode). The present invention is however not limited to these embodiments. The configurations of the above embodiments may be applied to the case where the tip 32 is welded to the electrode base 31 of the ground electrode 30 (that is, the ground electrode corresponds to the first electrode).

In the above embodiments, the spark plug 10 has a structure in which the resistor 70 is built in the insulator 40. The spark plug 10 is however not necessarily limited to such a structure. The present invention is naturally applicable to the production of a spark plug with no built-in resistor 70. In this case, the center electrode 50 and the metal terminal 60 are joined to each other through the conductive seal 71 by omitting the resistor 70 and the conductive seal 72.

All of cross sections of the first electrode taken along the center axis O do not necessarily satisfy the relationship of the interface shown in FIGS. 3 to 9. It suffices that one cross section of the first electrode taken along the center axis O satisfies the relationship of the interface shown in FIGS. 3 to 9. As long as one cross section of the first electrode taken along the center axis O satisfies the relationship of the interface shown in FIGS. 3 to 9, the first region performs a barrier function at least at such a site so as to restrict thermal expansion and thereby prevent separation of the tip from the fusion zone.

DESCRIPTION OF REFERENCE NUMERALS

10: Spark plug
30: Ground electrode (Second electrode)
50, 90, 100, 110, 120, 130, 140: Center electrode (First electrode)
52, 141: Electrode base
54: Tip
55, 150: Fusion zone
80: Imaginary straight line
81, 91, 101, 111, 121, 131, 151: Interface
82, 86, 92, 102, 112, 116, 122, 126, 132, 136, 152, 156: First region
83, 87, 93, 103, 113, 117, 123, 128, 133, 138, 153, 158: Second region
84, 88, 94, 104, 114, 118, 124, 129, 134, 139, 154, 159: Base point
O: Center axis Having described the invention, the following is claimed:

1. A spark plug comprising:

a first electrode having a column-shaped tip containing a noble metal, an electrode base supporting the tip thereon, and a fusion zone defined where the tip and the electrode base are fused together; and a second electrode facing the tip via a spark gap, wherein, in a cross section of the first electrode taken along a center axis of the tip, an interface of the fusion zone and the tip includes:

a first region shaped to be gradually farther away from an imaginary straight line in a direction parallel to the center axis with increase in distance from the center axis, assuming that the imaginary straight line extends perpendicular to the center axis at a position closer to the second electrode than the interface;

a second region shaped to be gradually closer to the imaginary straight line in the direction parallel to the center axis with increase in distance from the center axis; and a base point at which the first region and the second region are connected to each other, wherein the base point is located, among the first and second regions, farthest away from the imaginary straight line in the direction parallel to the center axis, wherein the first region, the second region and the base point are present on at least one side of the cross section with respect to the center axis, wherein the first region extends from the center axis to the base point, and wherein the base point is positioned so as to satisfy a condition of $0.1 \leq X/W \leq 0.4$ where W is a length of the interface in a direction perpendicular to the center axis; and X is a distance between the base point and the center axis.

2. The spark plug according to claim 1, wherein a set of the first region, the second region and the base point is present on each of both sides of the cross section with respect to the center axis.

* * * * *